US005775419A

United States Patent [19]

Gramlich

[11] Patent Number: 5,775,419

[45] Date of Patent: Jul. 7, 1998

[54] WELLHEAD LEAK CONTAINMENT DEVICE

[76] Inventor: Bruce Gramlich, General Delivery, Hayter, Alberta, Canada, I0B 1X0

[21] Appl. No.: 641,438

[22] Filed: May 1, 1996

[51] Int. Cl.[6] ..... E21B 33/08

[52] U.S. Cl. ..... 166/81.1; 166/84.1

[58] Field of Search ..... 166/84.1, 81.1, 166/68, 105, 84.5

[56] References Cited

U.S. PATENT DOCUMENTS

| | | | |
|---|---|---|---|
| 1,448,243 | 3/1923 | Wilson | 166/81.1 |
| 4,450,905 | 5/1984 | Crain | 166/81.1 |
| 5,150,751 | 9/1992 | Burton et al. | 166/81.1 |
| 5,211,227 | 5/1993 | Anderson | 166/84.1 |
| 5,246,067 | 9/1993 | Heinonen et al. | 166/81.1 |
| 5,351,753 | 10/1994 | Golson | 166/81.1 |
| 5,394,939 | 3/1995 | Walker | 166/84.1 X |
| 5,432,000 | 7/1995 | Young, Sr. et al. | 428/372 |
| 5,484,024 | 1/1996 | Ladd et al. | 166/369 |
| 5,540,283 | 7/1996 | Hahn | 166/81.1 X |

*Primary Examiner*—Frank Tsay
*Attorney, Agent, or Firm*—Suiter & Associates P.C.

[57] ABSTRACT

A device for attachment to a production wellhead of the type having a stuffing box and a rod string protruding from the upper end of the stuffing box, for collecting and retaining a fluid escaping from between the stuffing box and the rod string at the upper end of the stuffing box. The device comprises a housing for collecting the escaping fluid by surrounding the upper end of the stuffing box and a portion of the rod string adjacent thereto, and a replaceable absorbent material contained within the housing for retaining the escaping fluid which is collected in the housing. The device may also include a window mounted in the housing which facilitates viewing of the absorbent material from outside of the housing in order to determine when the absorbent material is saturated and should be replaced.

21 Claims, 10 Drawing Sheets

WELLHEAD LEAK CONTAINMENT DEVICE

TECHNICAL FIELD

The present invention relates to a device for attachment to a production wellhead of the type having a stuffing box, the stuffing box having an upper end, and having a rod string protruding from the upper end of the stuffing box, for collecting and retaining a fluid escaping from between the stuffing box and the rod string at the upper end of the stuffing box.

BACKGROUND ART

A typical production wellhead, for either a rotary or reciprocating well, includes a rod string extending from the surface to a wellbore beneath the surface containing a fluid such as hydrocarbons, a stuffing box and a driving or pumping unit connected to the rod string for producing the fluid from the wellbore by either rotating or reciprocating the rod string within the wellbore. The stuffing box is disposed about the rod string at the surface in a manner such that the rod string extends longitudinally through it, protruding out of the top of the stuffing box, and is allowed to either rotate or reciprocate within the stuffing box during production of the fluid from the wellbore. As well, the stuffing box also seals to the rod string as the rod string passes through the stuffing box in order to prevent the escape or leakage of any of the produced fluid from the stuffing box at the point where the rod string protrudes from the stuffing box. The seal is typically comprised of ring packing tightened around the rod string as it passes through the top of the stuffing box.

As the rod string rotates or reciprocates within the stuffing box, the ring packing tends to wear and as a result, the seal deteriorates. Deterioration of the seal tends to allow the fluid produced from the wellbore to escape or leak from the stuffing box between the packing and the rod string. The escaped fluid may leak onto the wellhead, which may pose a safety hazard. As well, the escaped fluid may leak onto the ground, which may present an environmental hazard, such as contamination of the soil. Both of these hazards typically require costly and time-consuming cleanup of the wellhead and the surrounding area. In addition, manual cleanup of the wellhead and the stuffing box can be hazardous, for instance, in using rags to clean the rotary wellhead and in using varsol or other solvents for the cleaning process. Use of varsol or other solvents in the cleaning process also provides the potential for contamination of the surrounding area. As a result, manual cleanup can be costly and subsequently, cost ineffective.

Various devices have been developed to address the deterioration of the stuffing box seal and the resultant problems by containing the escaping fluid within the device. For example, various types of containment devices are shown in U.S. Pat. No. 5,351,753 issued Oct. 4, 1994 to Golson, U.S. Pat. No. 5,246,067 issued Sep. 21, 1993 to Heinonen et al., U.S. Pat. No. 5,211,227 issued May 18, 1993 to Anderson, U.S. Pat. No. 5,150,751 issued Sep. 29, 1992 to Burton, U.S. Pat. No. 4,872,508 issued Oct. 10, 1989 to Gordon, and U.S. Pat. No. 4,665,976 issued May 19, 1987 to Retherford. All of these containment devices present similar difficulties or disadvantages with their use, as outlined below.

Each of the known containment devices is designed to simply collect the escaping fluid within a container or chamber in the device in a freely flowing form. Although the fluid is collected in the container, the fluid is not intended to be retained within that container. Rather, each of the devices includes a form of drain, drain valve or drain tubing The devices provide for the flow of the fluid out of the device through the drain. The drained fluid is then collected for disposal in a second storage container, typically located apart from the device.

Given that the escaped fluid is permitted to freely flow within these devices, a tight seal between the device and the stuffing box must be maintained during operation of the device in order to prevent leakage and spills from the device to the environment. Precautions are also required to prevent leakage or spills from either the drain structure or the second storage container.

Further, when the fluid produced from the wellbore includes a significant portion of heavy oil, or includes sand, clay or other particulate matter, the drains in these devices may become clogged or blocked, thus preventing proper drainage from the device. As well, when these devices are used in colder climates, the escaped fluid may freeze within the device or within the drain, thus, again, preventing proper drainage from the device. If the drain is incapable of functioning properly, or if the device does not include a drain at all, the fluid will simply collect within the device until the device is full and rendered inoperative.

To be operative again, the device would require cleaning which would include the removal of the escaped fluid from the device. Cleaning to remove the escaped fluid could likely only be accomplished by removing the device itself from the wellhead. Given the freely flowing form of the escaped fluid, removal of the device for cleaning may be a messy, time-consuming or difficult process that may also require the removal and cleanup of other portions of the wellhead, including the stuffing box. Further, cleaning of the device in this manner provides the potential for spills and contamination of either the wellhead or the ground. Finally, cleaning of the device in this manner may require breaking the seal between the stuffing box and the device, which may also allow leaks or spills to occur. Alternately, to avoid spills, the seal may need to be maintained throughout the cleaning process. The need to maintain the seal during cleaning of the device may complicate the structure of the device.

There is therefore a need in the industry for a device for collecting and retaining the fluid which tends to escape from the wellhead between the top of the stuffing box and the rod string. Further, there is a need for the device to allow for the removal of the escaped fluid in a relatively simple manner, as compared to known devices, which minimizes the risk of leaks or spills to the environment.

DISCLOSURE OF INVENTION

The present invention relates to a device for attachment to a production wellhead of the type having a stuffing box, the stuffing box having an upper end, and having a rod string protruding from the upper end of the stuffing box. The device collects and retains a fluid escaping from between the stuffing box and the rod string at the upper end of the stuffing box. The device specifically provides for the collection and retention of the fluid within the device and allows for the removal of the fluid from the device in a manner which tends to minimize the risk of leaks or spills to the environment. Further, the present invention relates to the device containing an absorbent material which absorbs and retains the escaping fluid within the device until such time that the absorbent material may be removed and replaced with further, clean absorbent material.

The present invention is a device for attachment to a production wellhead of the type having a stuffing box, the stuffing box having an upper end, and having a rod string protruding from the upper end of the stuffing box, for collecting and retaining a fluid escaping from between the stuffing box and the rod string at the upper end of the stuffing box, the device comprising:

(a) a housing for collecting the fluid escaping from the upper end of the stuffing box by surrounding the upper end of the stuffing box and a portion of the rod string adjacent thereto, the housing having an upper surface, a lower surface for abutting the stuffing box to mount the housing on top of the stuffing box, and a side wall extending between the upper surface and the lower surface, the lower surface defining a first opening for communication with the upper end of the stuffing box, the first opening sized to permit the rod string to pass therethrough and sized to permit the escaping fluid to pass from the stuffing box into the housing when the housing is mounted on top of the stuffing box, and the upper surface defining a second opening sized to permit the rod string to pass therethrough so that when the housing is mounted on top of the stuffing box, the rod string protrudes from the upper end of the stuffing box, through the first opening and through the second opening; and (b) an absorbent material contained within the housing for retaining the escaping fluid collected in the housing when the housing is mounted on top of the stuffing box.

The housing may be of a one piece construction, but preferably comprises at least two complementary longitudinal sections which can be at least partially separated to facilitate the mounting of the housing on top of the stuffing box and which can be joined together once the housing is on top of the stuffing box to facilitate collection of the escaping fluid by the housing. If the housing is of a one piece construction, it is necessary to remove any apparatus connected to the wellhead above the stuffing box before mounting the housing on top of the stuffing box, in order that the housing can be placed over top of the polished rod. The housing also preferably comprises a seal assembly associated with its lower surface for providing a seal between the stuffing box and the housing when the housing is mounted on top of the stuffing box.

The device also preferably comprises means for securing the housing to the stuffing box, and where the housing comprises at least two complementary longitudinal sections, the device preferably also comprises means for connecting the longitudinal sections of the housing.

The absorbent material is preferably removable from the housing and replaceable so that it may be replaced when it becomes saturated with the escaping fluid. The absorbent material preferably comprises at least one layer contained within the housing, and the layer of absorbent material preferably comprises at least one sorbent pad which is preferably contained within the housing so that it is substantially parallel to the side wall of the housing, extends substantially from the lower surface to the upper surface of the housing, and extends substantially around the entire side wall of the housing.

The device may also comprise means for maintaining the position of the absorbent material within the housing, which means may be comprised of a plurality of elongated pins extending longitudinally through the housing for at least a portion of the distance between the upper surface and the lower surface, so that the absorbent material may be contained within the housing between the side wall and the pins.

The device may also comprise means for indicating the retention of the escaping fluid by the absorbent material without removing the absorbent material from the housing. The indicating means may comprise means for viewing the absorbent material contained within the housing from outside of the housing, which viewing means may be comprised of a window mounted in the side wall of the housing.

In the preferred embodiment, the housing comprises a first longitudinal section having a first longitudinal edge and a second longitudinal edge, and comprises a second longitudinal section having a third longitudinal edge and a fourth longitudinal edge. In the preferred embodiment, the connecting means comprises a first fastener assembly associated with the longitudinal sections for connecting the first and fourth longitudinal edges in joined relationship when the longitudinal sections are joined together, and comprises a second fastener assembly associated with the longitudinal sections for connecting the second and third longitudinal edges in joined relationship when the longitudinal sections are joined together.

In one version of the preferred embodiment, the upper end of the stuffing box has an outer circumference, the first opening is sized to abut firmly the outer circumference when the housing is mounted on top of the stuffing box, and the housing is secured to the stuffing box by the connecting means, which urges the first opening into firm abutment with the outer circumference. In this version of the preferred embodiment, the first opening preferably comprises a seal assembly located around the perimeter of the first opening, which seal assembly is preferably compressible so that the connecting means operate to compress the seal assembly about the outer circumference in order to more firmly secure the housing to the stuffing box.

In a second version of the preferred embodiment, the stuffing box includes at least one flange, and the securing means are comprised of at least one mounting tab located on the housing and at least one fastener for fastening the mounting tab to the flange. In this second version of the preferred embodiment, the flange may define a first aperture, the mounting tab may define a second aperture, and the fastener may comprise ; bolt having an end sized for passing through the apertures and a nut for threading onto the end of the bolt once the bolt has passed through the apertures. In this second version of the preferred embodiment, the upper end of the stuffing box preferably has a top surface, the lower surface of the housing preferably abuts the top surface when the housing is mounted on the stuffing box, and the lower surface may comprise a seal assembly for providing a seal between the housing and the top surface of the upper end of the stuffing box.

BRIEF DESCRIPTION OF DRAWINGS

Embodiments of the invention will now be described with reference to the accompanying drawings in which.

BEST MODE OF CARRYING OUT INVENTION

Figure 1:
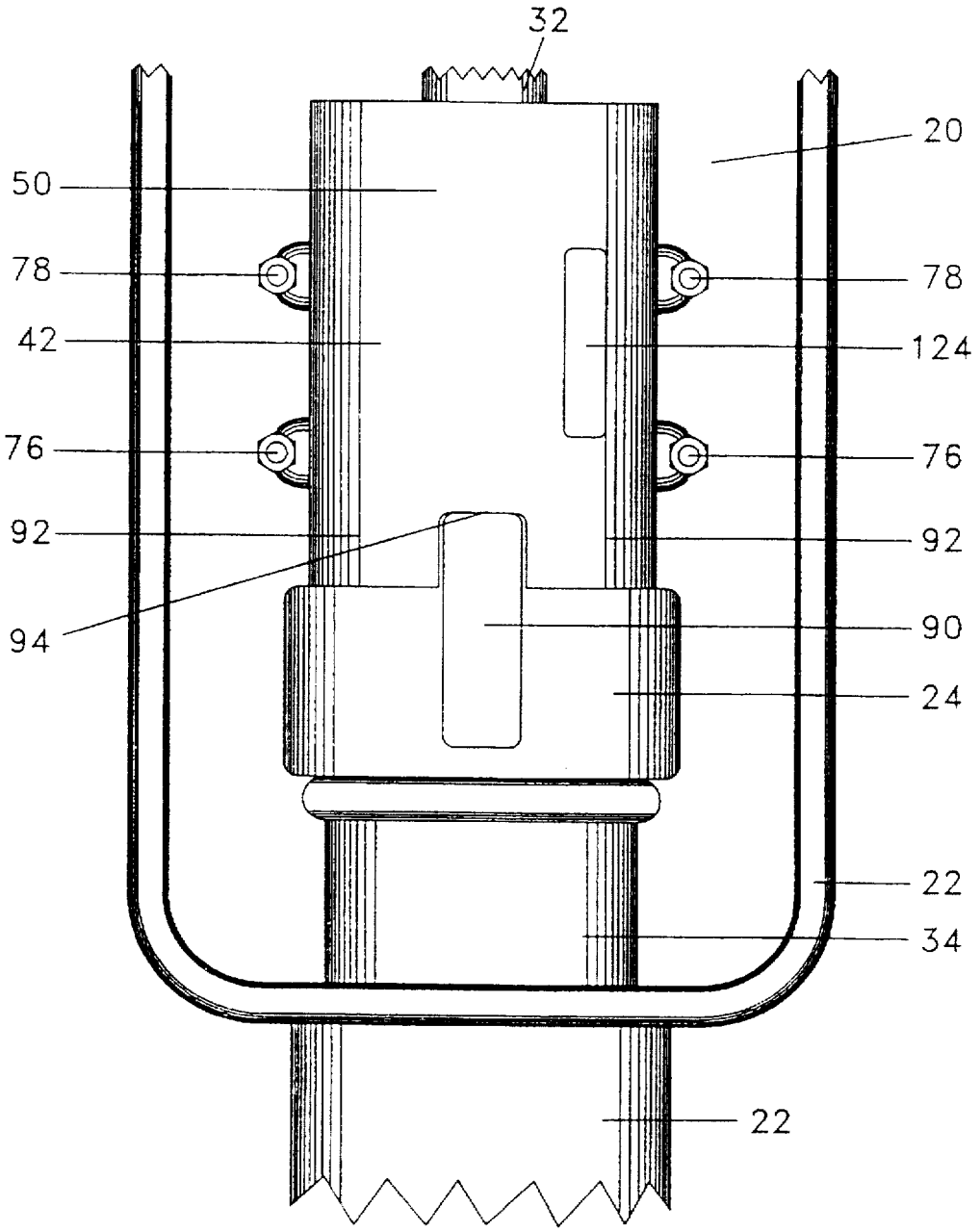
FIG. 1 is a pictorial side view of a production wellhead having a rotating rod string, in which a preferred first embodiment of a device is mounted for operation.
Figure 2:
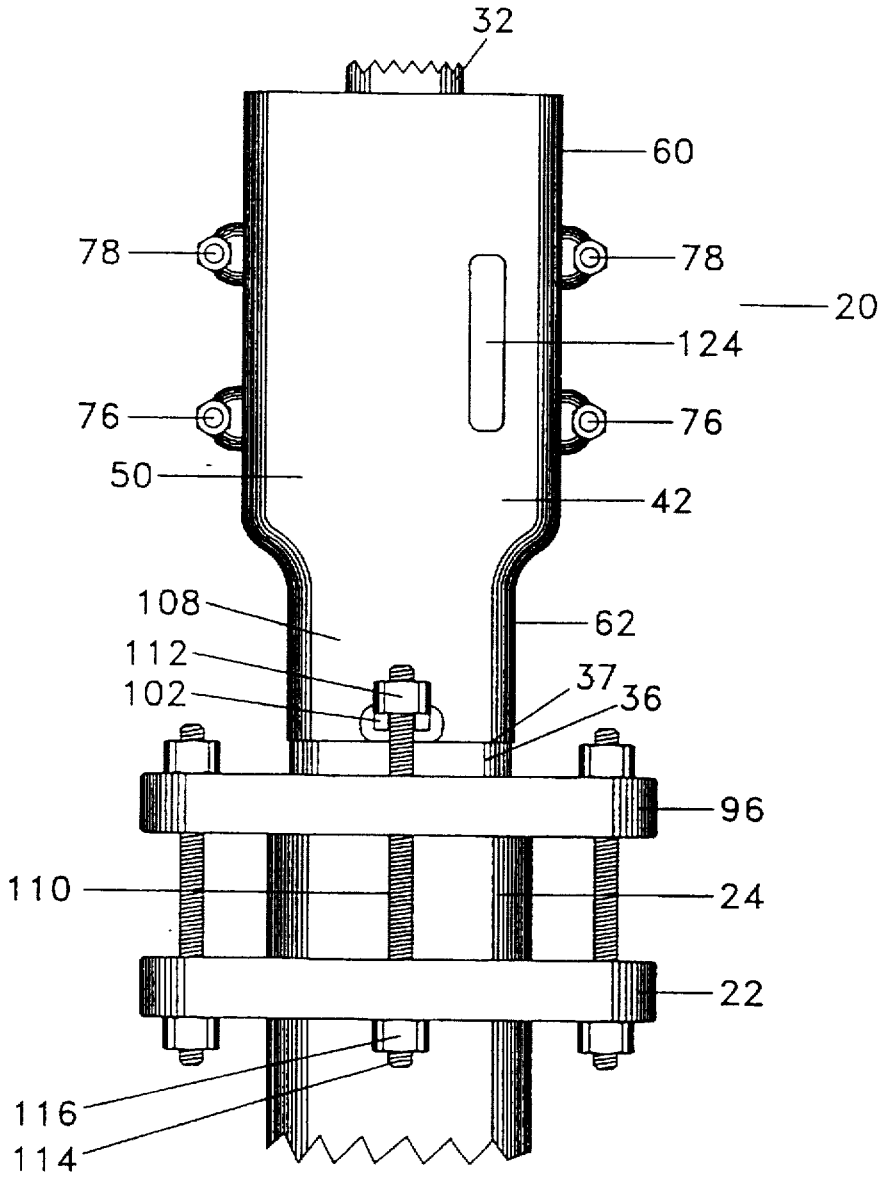
FIG. 2 is a pictorial side view of a production wellhead having a reciprocating rod string, in which a preferred second embodiment of the device is mounted for operation.

Referring to FIGS. 1 and 2, the within invention is a device (20) for attachment to a production wellhead (22) located at the surface adjacent a wellbore beneath the surface containing a fluid to be produced by the wellhead (22). A conventional production wellhead (22) includes a stuffing box (24), a rod string and means for driving the rod string by either rotating or reciprocating the rod string in order to pump the fluid from the wellbore. As described further below, the rod string extends through the stuffing box (24) and there is a tendency for the fluid produced from the wellbore to leak or escape at this location. The device (20) is designed to collect and retain this escaped fluid.

The fluid contained within the wellbore, to be produced by the wellhead (22), may be any liquid having any composition capable of being produced by the wellhead (22) but is typically comprised of hydrocarbons. However, the fluid is rarely homogeneous and may include a combination of hydrocarbons, such as oil, and other liquids, such as water. As well, the fluid may include an amount of solid particulate matter, such as sand, clay or mineral particles.

In the production wellhead (22), the rod string extends from an upper end at the surface, through the other components of the wellhead (22) and into the wellbore beneath the surface to a lower end. The rod string includes a polished rod (32) adjacent its upper end, which polished rod (32) extends through the stuffing box (24). The polished rod (32) provides a smooth sealable surface between the rod string and the stuffing box (24). The stuffing box (24) has a lower end (34) and an upper end (36), and is disposed about the polished rod (32) such that the polished rod (32) extends longitudinally through the stuffing box (24) from its lower end (34) to project or protrude from its upper end (36). The upper end (36) of the stuffing box (24) has a top surface (37), being the uppermost surface of the stuffing box (24) nearest the upper end of the rod string, and has an outer circumference. The device (20) is attached to the wellhead (22) on top of the stuffing box (24) between the stuffing box (24) and the upper end of the rod string.

The driving means of the wellhead (22) are also typically connected to the polished rod (32) at or adjacent to the upper end of the rod string. In a rotary wellhead (22), as shown in FIG. 1, the driving means are comprised of a conventional rotary pump. As indicated, the rotary pump is operatively connected at or near the upper end of the rod string in order to rotate the rod string about its longitudinal axis while the rod string is suspended within the wellhead (22) and the wellbore. The longitudinal axis of the rod string extends from its upper end to its lower end. In a reciprocating wellhead (22), as shown in FIG. 2, the driving means are comprised of a walking beam. The walking beam is operatively connected to the upper end of the rod string such that the walking beam suspends and supports the rod string in the wellbore and rocking of the walking beam causes the rod string to reciprocate along its longitudinal axis.

From the wellbore to the stuffing box (24), the rod string is exposed to and may come into contact with the produced fluid. The stuffing box (24) provides a seal to the rod string, and in particular the polished rod (32), in order to inhibit the passage of the produced fluid out of the stuffing box (24) at the point where the polished rod (32) protrudes from the upper end (36) of the stuffing box (24). This seal is typically comprised of ring packing tightened around the polished rod (32) as it passes through the stuffing box (24). Although tightened to the polished rod (32), the stuffing box (24) and the seal permit the polished rod (32) to rotate about its longitudinal axis when the production wellhead (22) is a rotary wellhead. When the production wellhead (22) is a reciprocating wellhead, the stuffing box (24) and the seal permit the polished rod (32) to reciprocate in a direction along its longitudinal axis. As discussed above, rotation or reciprocation of the polished rod (32) causes the packing in the stuffing box (24) to wear over time resulting in a deterioration of the seal. The wearing and deterioration will increase as the amount of solid or particulate matter in the produced fluid increases, and may also be increased by the surrounding environmental conditions, such as colder climates. The seal may also deteriorate for any other known reasons, such as lack of use over an extended period of time. Deterioration of the seal will result in the escape or leakage of the produced fluid. However, deterioration of the seal may not be the only cause of the escaping fluid. For instance, misalignment of the polished rod (32) in the stuffing box (24) could prevent a proper seal from occurring between them. However, regardless of the specific cause of the leak, the escaping fluid will be collected and retained by the device (20) when it is mounted on the wellhead (22) in the manner described herein.

As stated, the device (20) is attached to the wellhead (22) in order to collect and retain the fluid escaping from between the stuffing box (24) and the polished rod (32) at the upper end (36) of the stuffing box (24). Referring to FIGS. 3–10, the device (20) is comprised of a housing (42) for collecting the fluid and an absorbent material (44) for retaining the escaping fluid collected in the housing (42) when the housing (42) is mounted on top of the stuffing box (24). The device (20) has two preferred embodiments depending upon whether the device (20) is to be mounted on a rotary or a reciprocating wellhead (22). FIGS. 1, 3, 5, 7 and 9 depict the first preferred embodiment of the device (20) for a rotary wellhead (22), while FIGS. 2, 4, 6, 8 and 10 depict the second preferred embodiment of the device (20) for a reciprocating wellhead (22). The primary distinction between the preferred embodiments is with respect to the specific structure provided for mounting the device (20) on top of the stuffing box (24). Otherwise, unless specifically indicated, the device (20) is the same for both the first and second preferred embodiments.

Referring to FIGS. 1 and 2, the housing (42) is designed to surround both the upper end (36) of the stuffing box (24) and a portion (45) of the polished rod (32) immediately adjacent the upper end (36) of the stuffing box (24). In other words, the housing (42) encloses or encompasses the location at which it is anticipated that the produced fluid will escape, that is, between the upper end (36) of the stuffing box (24) and the polished rod (32), in order that the escaping fluid may be collected in the housing (42). The housing (42) has an upper surface (46), a lower surface (48) for abutting the stuffing box (24) to removably mount the housing (42) on top of the stuffing box (24), and a side wall (50) extending between the upper surface (46) and the lower surface (48). The housing (42) may be made of any material capable of containing the absorbent material (44) and capable of collecting the fluid. The housing (42) is preferably made of steel, but may be made of any other material such that the housing (42) may perform its function, such as plastic.

The lower surface (48) of the housing (42) defines a first opening (52) for communication with the upper end (36) of the stuffing box (24). The first opening (52) is sized to permit the polished rod (32) to pass therethrough such that it can freely rotate or reciprocate in the first opening (52) and to permit the escaping fluid to pass from the stuffing box (24) into the housing (42) when the housing (42) is mounted on top of the stuffing box (24). Thus, when the housing (42) is so mounted, the escaping fluid is able to pass into the housing (42) through a passage (54) or space formed between, or defined by, the side wall (50) of the housing (42) and the polished rod (32). The fluid flows from the stuffing box (24), between the stuffing box (24) and the polished rod (32) through the passage (54) for collection in the housing (42).

Further, the upper surface (46) of the housing (42) defines a second opening (56). The second opening (56) is sized to permit the polished rod (32) to pass therethrough and to freely rotate or reciprocate in the second opening (56). Thus, when the housing (42) is mounted on top of the stuffing box (24), the polished rod (32) extends from the upper end (36) of the stuffing box (24) through the first opening (52) and the second opening (56). Then, the upper end (28) of the polished rod (32) projects away from the upper surface (46) of the housing (42). Preferably, the second opening (56) is sized to be just large enough to permit the polished rod (32) to pass therethrough. This sizing inhibits the passage of the escaped fluid out of the housing (42) through the second opening (56) and facilitates the containment of the absorbent material (44) within the housing (42). Further, a seal is preferably provided about the perimeter of the second opening (56) in order to further inhibit the passage of any escaped fluid out of the housing (42) through the second opening (56). Preferably, this seal is comprised of a ring of nitrile rubber, but may also be comprised of any other suitable matter capable of performing the sealing function.

Similarly, the first opening (52) is also preferably sized to be just large enough to permit the polished rod (32) to pass therethrough and to provide the passage (54) for the fluid. This sizing allows the fluid to pass into the housing (42) while facilitating the containment of the absorbent material (44) retaining the escaped fluid within the housing (42). The absorbent material (44) should be sufficient to absorb and retain a desired quantity of the escaping fluid. Thus, the stuffing box (24) may not need to be sealed to the housing (42). This is particularly so when the fluid is comprised of a heavy oil. However, when the fluid is comprised primarily of a light oil or water, or the absorbent material (44) cannot readily absorb and retain the fluid for any other reason, a seal between the first opening (52) and the upper end (36) of the stuffing box (24) is required. Therefore, a seal assembly (58) is preferably associated with the lower surface (48) of the housing (42). The seal assembly (58) provides a seal between the stuffing box (24) and the housing (42) when the housing (42) is mounted on top of the stuffing box (24). Preferably, the seal assembly (58) is comprised of a seal mounted about the perimeter of the first opening (52). This seal assembly (58) is described further below. However, the seal assembly (58) is preferably comprised of nitrile rubber, but it may be made of any material capable of performing the sealing function. Preferably, the material is durable, resistant to hydrocarbons and capable of withstanding temperature variations, and particularly, colder climates.

In the preferred embodiments, the upper surface (46) of the housing (42) is cut out of a steel plate. Once the second opening (56) is cut out of the upper surface (46), the perimeter of the upper surface (46) is welded to the side wall (50) of the housing (42). Preferably, the lower surface (48) is also cut out of steel plate. Once the first opening (52) is cut out of the lower surface (48), the perimeter of the lower surface (48) is welded to the side wall (50) of the housing (42).

Figure 7:
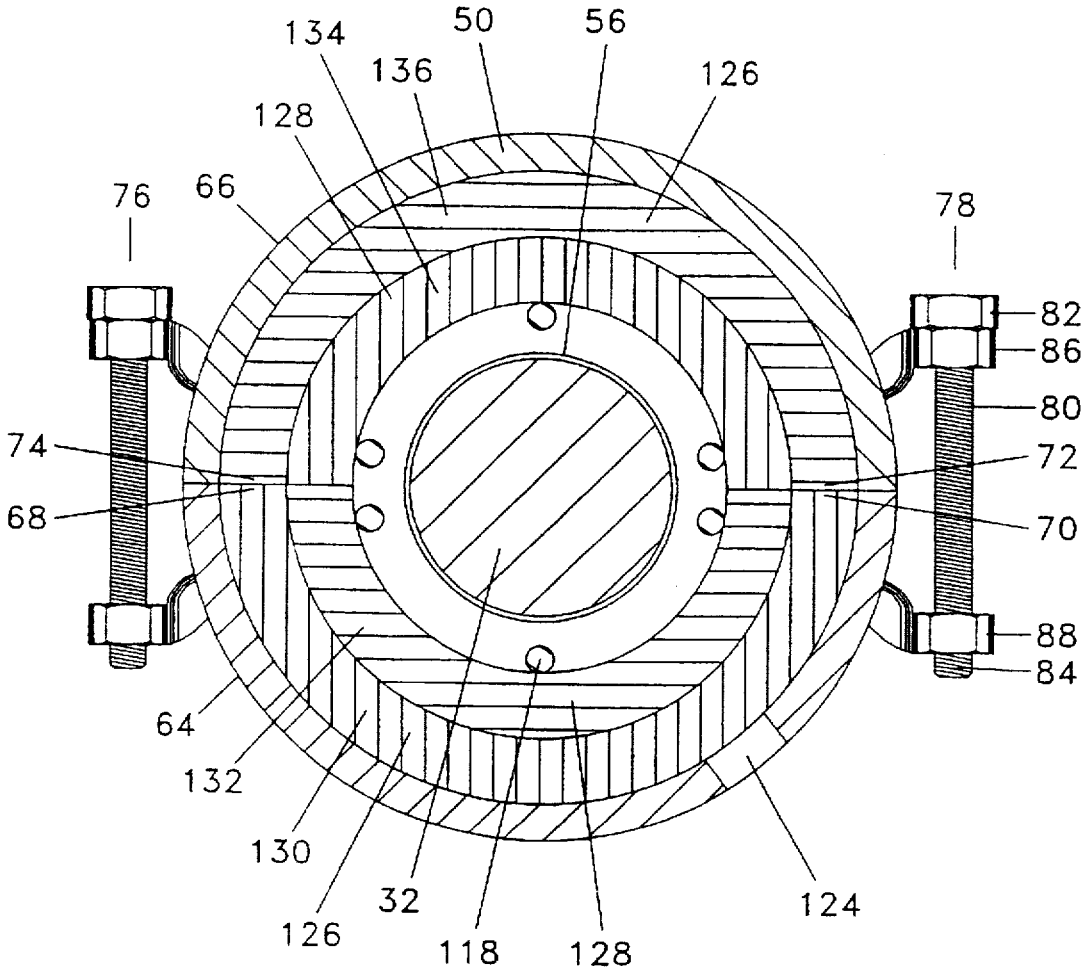
FIG. 7 is a cross-section of the first embodiment of the device along line 7—7 of FIG. 3.
Figure 8:
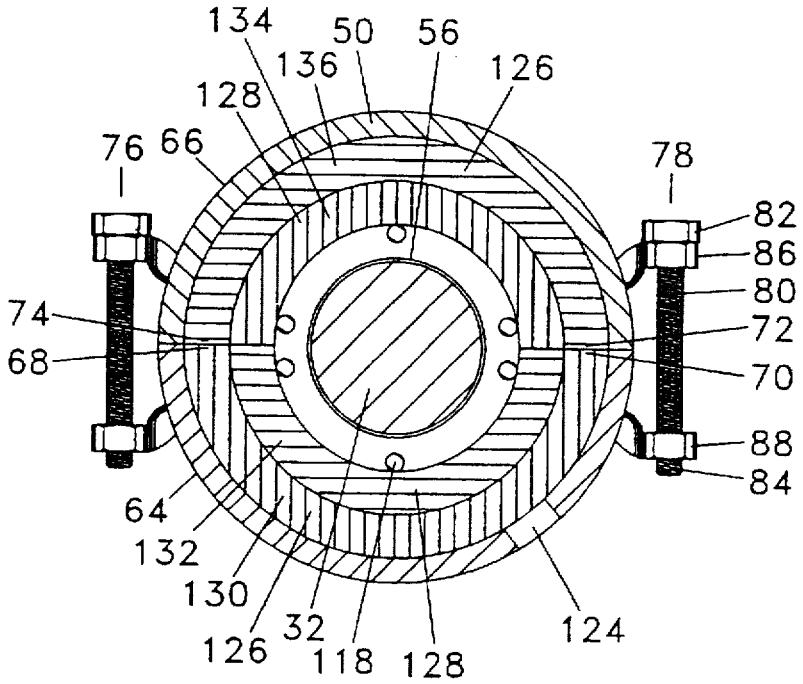
FIG. 8 is a cross-section of the second embodiment of the device along line 8—8 of FIG. 4.

As well, preferably, the side wall (50) of the housing (42) is cylindrical on cross-section, as shown in FIGS. 7 and 8. In the first preferred embodiment for a rotary wellhead (22), as shown in FIGS. 3, 5, 7 and 9, the housing (42) is simply cut out of a steel pipe. The diameter of the housing (42) on cross-section is constant from the upper surface (46) to the lower surface (48). The diameter of the side wall (50) of the housing (42) is chosen to permit the polished rod (32) to pass therethrough and to accommodate an amount of the absorbent material (44) sufficient for collecting and retaining a desired quantity of the fluid. In this first preferred embodiment, the specific dimensions of the device (20) may vary depending upon the dimensions and configuration of the particular wellhead (22) to which the device (20) is to be mounted. However, in a specific instance of the first preferred embodiment, the diameter of the cross-section of the housing (42) is about 4⅜ inches and the distance between the upper surface (46) and the lower surface (48) is about 6 inches. The diameter of the first opening (52) is about 4¼ inches and the diameter of the second opening (56) is about 1⅝ inches. The seal assembly (58) in the first opening (52) is comprised of a ring made of nitrile rubber mounted about the perimeter of the first opening (52) for abutting the circumference of the upper end (36) of the stuffing box (24).

Figure 4:
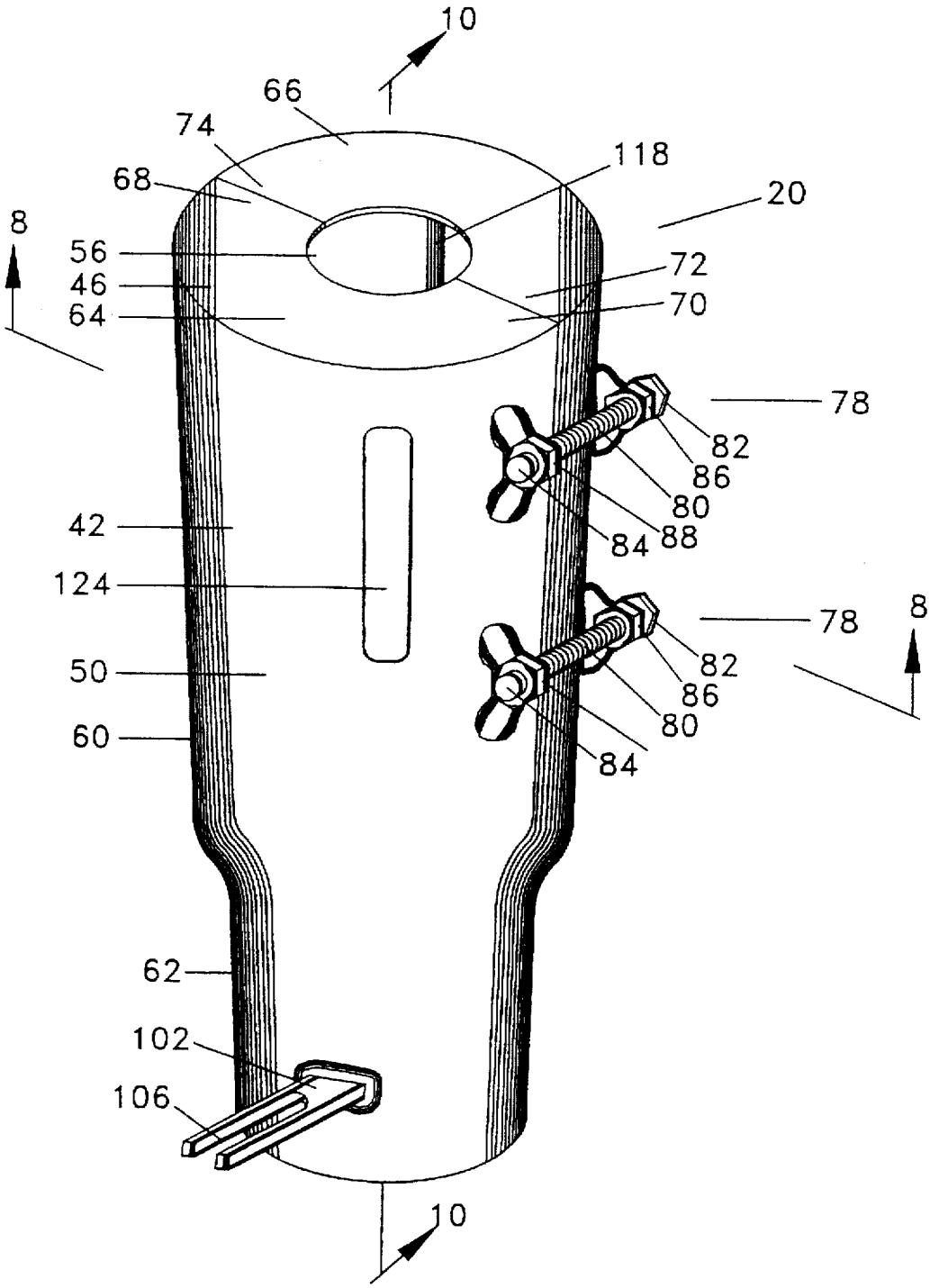
FIG. 4 is a pictorial top and side view of the second embodiment of the device shown in FIG. 2.
Figure 5:
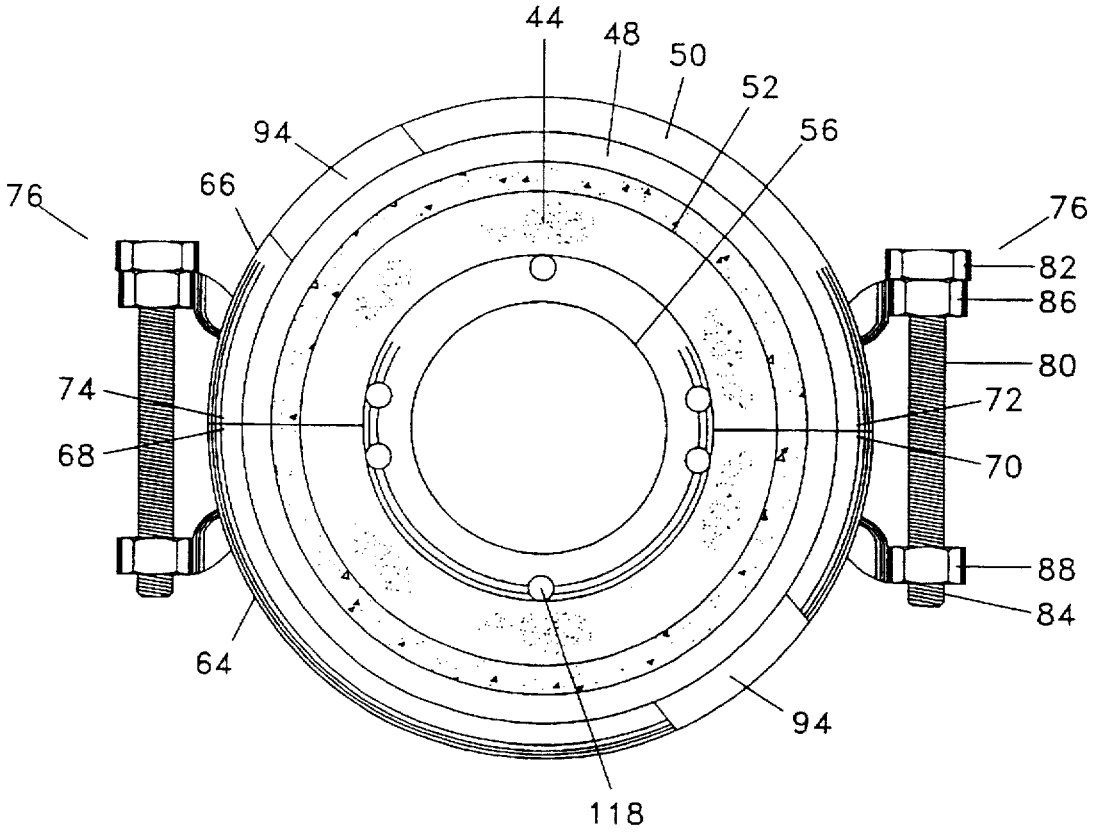
FIG. 5 is a bottom view of the first embodiment of the device shown in FIG. 1.
Figure 6:
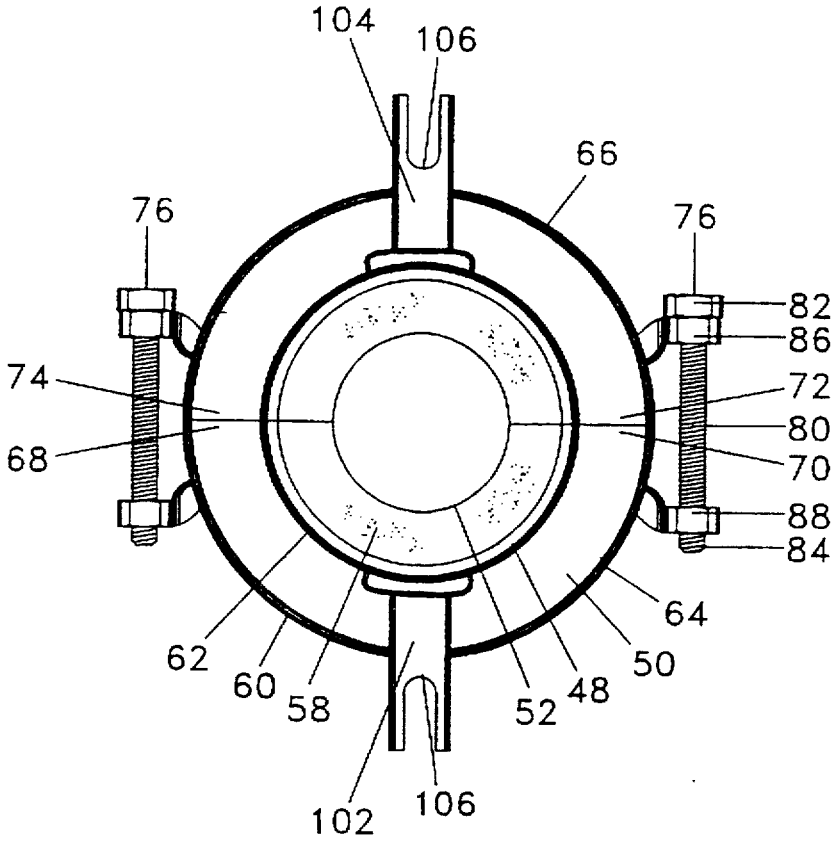
FIG. 6 is a bottom view of the second embodiment of the device shown in FIG. 2.
Figure 10:
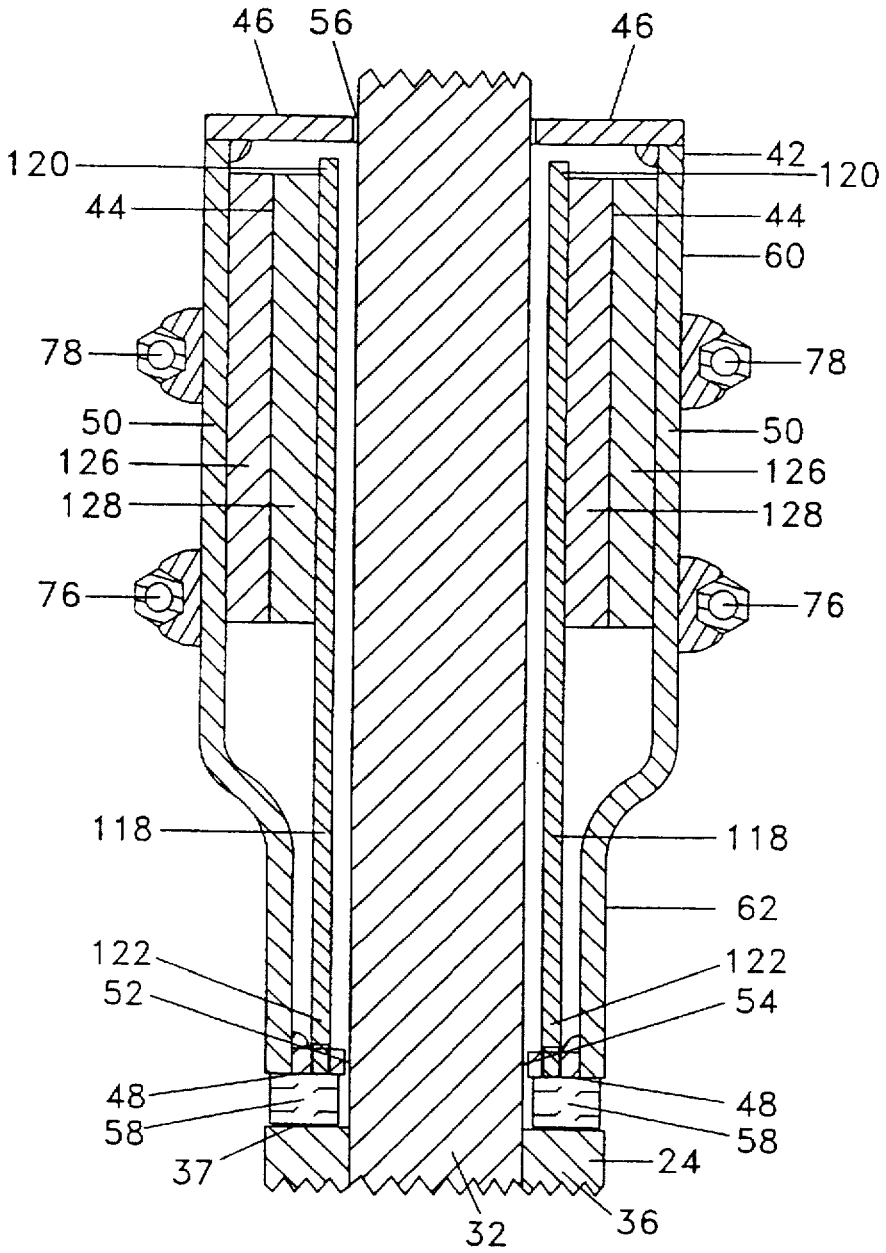
FIG. 10 is a longitudinal section of the second embodiment of the device along line 10—10 of FIG. 4.

In the second preferred embodiment of the device (20) for a reciprocating wellhead (22), as shown in FIGS. 4, 6, 8 and 10, the housing (42) is made out of a weld swedge. In order that the housing (42) is mountable to the top of the stuffing box (24) in this second preferred embodiment in the manner set out below, the diameter of the housing (42) on cross-section, as shown in FIGS. 4 and 10, is greater at the upper surface (46) than at the lower surface (48). Specifically, the diameter of an upper portion (60) of the housing (42) adjacent the upper surface (46) is chosen to permit the polished rod (32) to pass therethrough and to accommodate an amount of the absorbent material (44) sufficient for collecting and retaining the desired quantity of the fluid. The side wall (50) slopes from the upper portion (60) to a lower portion (62) adjacent the lower surface (48) of the housing (42). As stated, the diameter of the lower portion (62) of the housing (42) is chosen to permit the housing (42) to be mounted to the top of the stuffing box (24), while also permitting the polished rod (32) to pass therethrough and to provide the passage (54) for the fluid. In this second preferred embodiment, the specific dimensions of the device (20) may also vary depending upon the dimensions and configuration of the particular wellhead (22) to which the device (20) is to be mounted. However, in a specific instance of the second preferred embodiment, the diameter of the cross-section of the upper portion (60) of the housing (42) is about 4⅜ inches and the diameter of the cross-section of the lower portion (62) is about 3⅜ inches. The distance between the upper surface (46) and the lower surface (48) is about 9⅛ inches. Further, the diameter of the first opening (52) is about 1½ inches and the diameter of the second opening (56) is about 1½ inches. The seal assembly (58) in the first opening (52) is preferably comprised of a ring made of nitrile rubber mounted on the lower surface (48) of the housing (42) adjacent the perimeter of the first opening (52) for abutting the top surface (37) of the stuffing box (24), but may also be comprised of a conventional gasket.

The side wall (50) of the housing (42), and both the upper and lower surfaces (46, 48), may form a single piece or unit comprising the housing (42). However, in order to mount a one-piece unit on top of the stuffing box (24), it is likely that the wellhead (22), or a portion of it, would require disassembly. Given the potential inconvenience and disadvantages of mounting the housing (42) when formed as a one-piece unit, it is preferable that the housing (42) be formed from at least two complementary longitudinal sections.

In both preferred embodiments, the housing (42) is preferably comprised of at least two complementary longitudinal sections which can be at least partially separated. This partial separation facilitates the mounting of the housing (42) on top of the stuffing box (24) as the housing (42) may be mounted without the need to disassemble the wellhead (22). Further, the partial separation allows the absorbent material (44) to be more easily installed in and removed from the housing (42). Once the housing (42) is mounted, the longitudinal sections are capable of being joined together in order to facilitate the collection of the escaping fluid within the housing (42).

The housing (42) may include any number of complementary longitudinal sections capable of being partially separated and joined together again. However, in the preferred embodiments, the housing (42) is comprised of two complementary longitudinal sections. Referring to FIGS. 3–8, the housing (42) includes a first longitudinal section (64) and a second longitudinal section (66). Preferably, the two longitudinal sections (64, 66) divide the housing (42) into approximately equal halves, each half including a portion of the side wall (50), the upper surface (46) and the lower surface (48). Further, as described below, means are provided for connecting the longitudinal sections (64, 66) when they are joined together in order to maintain the longitudinal sections (64, 66) in joined relationship with each other.

The first longitudinal section (64) includes a first longitudinal edge (68) and a second longitudinal edge (70). The second longitudinal section (66) includes a third longitudinal edge (72) and a fourth longitudinal edge (74). Each longitudinal edge (68, 70, 72, 74) extends from the first opening (52), through the lower surface (48), the side wall (50) and the upper surface (46), to the second opening (56). When the sections (64, 66) are joined together, the first longitudinal section (68) is in joined relationship with the fourth longitudinal edge (74) and the second longitudinal edge (70) is in joined relationship with the third longitudinal edge (72). The connecting means maintain these joined relationships. A seal assembly comprised of any suitable material, such as nitrile rubber, may be provided between the first and fourth longitudinal edges (68, 74) and the second and third longitudinal edges (70, 72) to assist in retaining the fluid in the device (20).

In the preferred embodiments, the longitudinal sections (64, 66) are completely and fully separable from each other. Complete separability means that the first longitudinal edge (68) is movable away from the fourth longitudinal edge (74) such that they are apart from each other and similarly, the second longitudinal edge (70) is movable away from the third longitudinal edge (72) such that they are also apart from each other. In the preferred embodiments, the connecting means allow for this complete separation. However, although preferred, complete separation or separability is not necessary as long as the sections (64, 66) are at least partially separable a sufficient amount to facilitate mounting of the housing (42). Partial separability means that both pairs of connecting longitudinal edges need not be separable, as long as one pair is separable and the other pair allows for, or does not prevent, that separation. For example, the first and fourth longitudinal edges (68, 74) may be separable, while the second and third longitudinal edges (70, 72) remain in abutment. Thus, the connecting means for the first and fourth longitudinal edges (68, 74) would allow for separation, while the connecting means for the second and third longitudinal edges (70, 72) would maintain the contact between the edges. The connecting means which allow for separation are described further below. The connecting means used to maintain contact between the edges may take the form of a hinge, a flexible connector or any other fastener capable of maintaining the contact between one pair of longitudinal edges, such as the second and third longitudinal edges (70, 72), while allowing the separation of the other pair of longitudinal edges, such as the first and fourth longitudinal edges (68, 74).

In the preferred embodiments, the connecting means allow for each pair of abutting longitudinal edges to be separated from each other. The connecting means for each pair of abutting longitudinal edges may be comprised of a single fastener assembly such as a retaining ring surrounding the entire side wall (50) of the housing (42), a clamp, or any other fastener capable of performing the necessary function. However, preferably, each pair of abutting longitudinal edges is provided with their own fastener assembly. Thus, the first and fourth longitudinal edges (68, 74) are associated with a first fastener assembly and the second and third longitudinal edges (70, 72) are associated with a second fastener assembly. The first and second fastener assemblies are preferably identical, although they need not be.

Each fastener assembly may include any number of fasteners as long as it includes at least one fastener. In the preferred embodiments, each fastener assembly includes a first fastener (76) and a second fastener (78) located a spaced distance apart from each other along the abutting longitudinal side edges. The second fastener (78) is preferably located adjacent the upper surface (46) of the housing (42), while the first fastener (76) is located a spaced distance from the second fastener (78), nearer the lower surface (48). The first and second fasteners (76, 78) are preferably identical, although they need not be.

Figure 3:
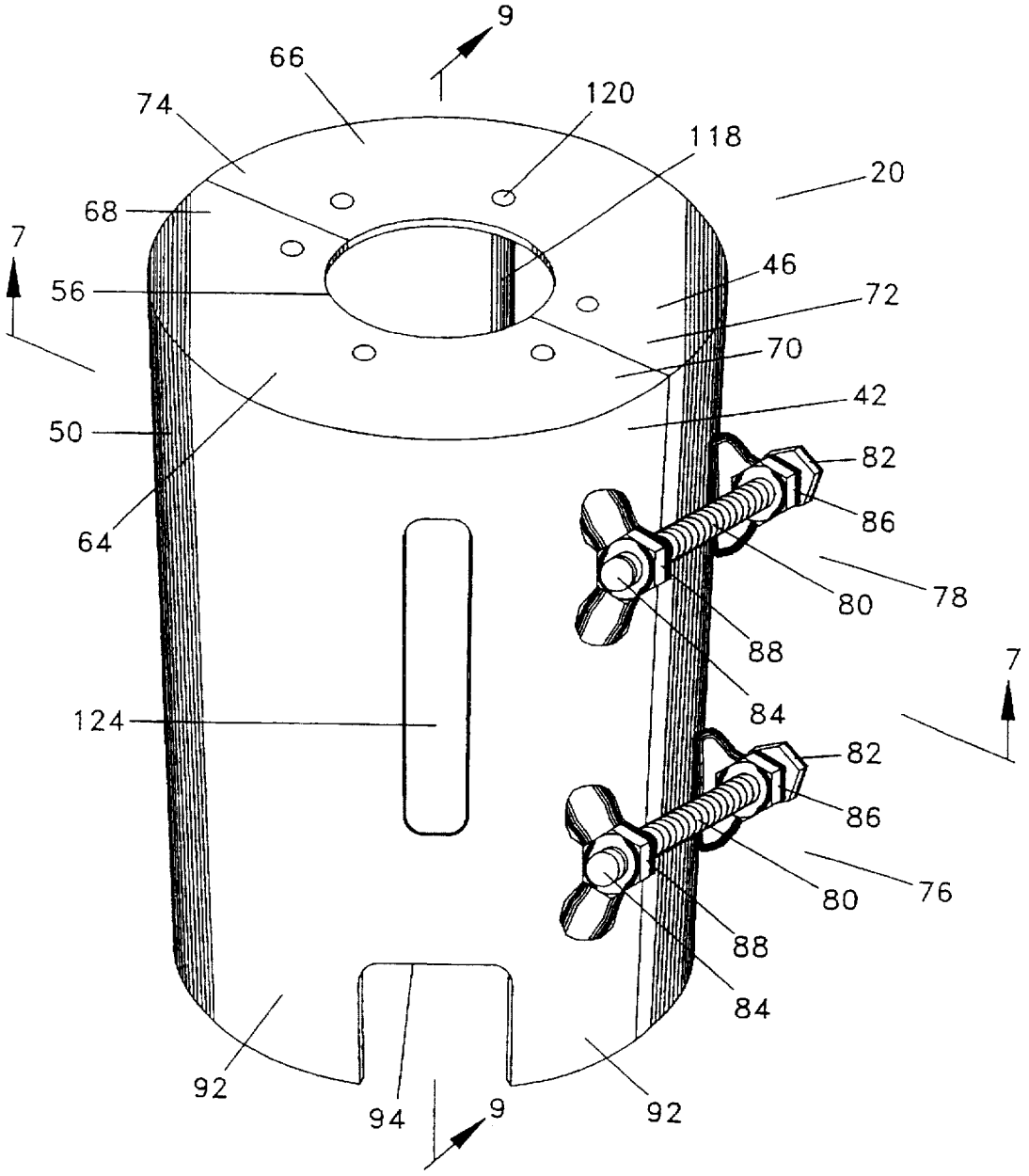
FIG. 3 is a pictorial top and side view of the first embodiment of the device shown in FIG. 1.

Any form of fastener may be used which is capable of accomplishing the desired function, such as a bolt, screw, clamp or clamping ring. However, in the preferred embodiments, each fastener (76, 78) is comprised of a threaded bolt (80), having an enlarged first end (82) and a second end (84), a retaining nut (86) and a receiving nut (88). The retaining nut (86) is honed or reamed to provide a smooth inner surface and is welded to one longitudinal edge. The receiving nut (88) has a threaded inner surface compatible with the threaded surface of the bolt (80) and is welded to the adjacent longitudinal edge. The nuts (86, 88) are welded to the longitudinal edges adjacent each other and in a manner such that the second end of the bolt (80) may be passed through the retaining nut (86) and into the receiving nut (88) for threaded engagement therewith, as shown in FIGS. 2 and 3. The enlarged first end (82) of the bolt (80) prevents its passing through the retaining nut (86). Thus, screwing of the bolt (80) into the receiving nut (88) causes the nuts (86, 88) to be moved closer together, which connects or abuts the adjacent longitudinal edges.

The device (20) is further preferably comprised of means for securing the housing (42) to the stuffing box (24) when the housing (42) is mounted on top of the stuffing box (24). Any structure capable of securing the housing (42) may be used. The securing means may be associated with the housing (42) and connected to it, or may be comprised of a completely separate element of the device. However, the preferred securing means are described below. The preferred securing means for the first and second preferred embodiments differ somewhat as a result of the differences in the stuffing boxes (24) typically associated with the rotary and reciprocating wellheads (22) respectively.

The upper end (36) of the stuffing box (24) typically found on the rotary wellhead (22), as shown in FIG. 1, is of a sufficient length to allow the device (20) to be securely mounted thereto. To mount the housing (42) in the first preferred embodiment of the device (20), the first opening (52) in the lower surface (48) is sized to firmly abut the outer circumference of the upper end (36) of the stuffing box (24) when the housing (42) is mounted on top of the stuffing box (24). Specifically, to mount the housing (42), the first opening (52) is placed about the upper end (36) of the stuffing box (24) so that the perimeter of the first opening (52) abuts the outer circumference of the upper end (36) of the stuffing box (24). Once mounted, operation of the connecting means, and in particular, the first and second fastener assemblies, assists in securing the housing (42) to the upper end (36) by abutting the first and second longitudinal sections (64, 66) which correspondingly urges the perimeter of the first opening (52) into firm abutment with the outer circumference of the upper end (36) of the stuffing box (24). Thus, the securing means are comprised of the connecting means.

Further, as indicated previously, the first opening (52) preferably includes a seal assembly (58) about its perimeter. This seal assembly (58) is preferably compressible so that operation of the fastener assemblies also compresses the seal assembly (58) between the perimeter of the first opening (52) and the outer circumference of the upper end (36) of the stuffing box (24). Compression of the seal assembly (58) causes, or facilitates, the first opening (52) to firmly abut the upper end (36).

Figure 9:
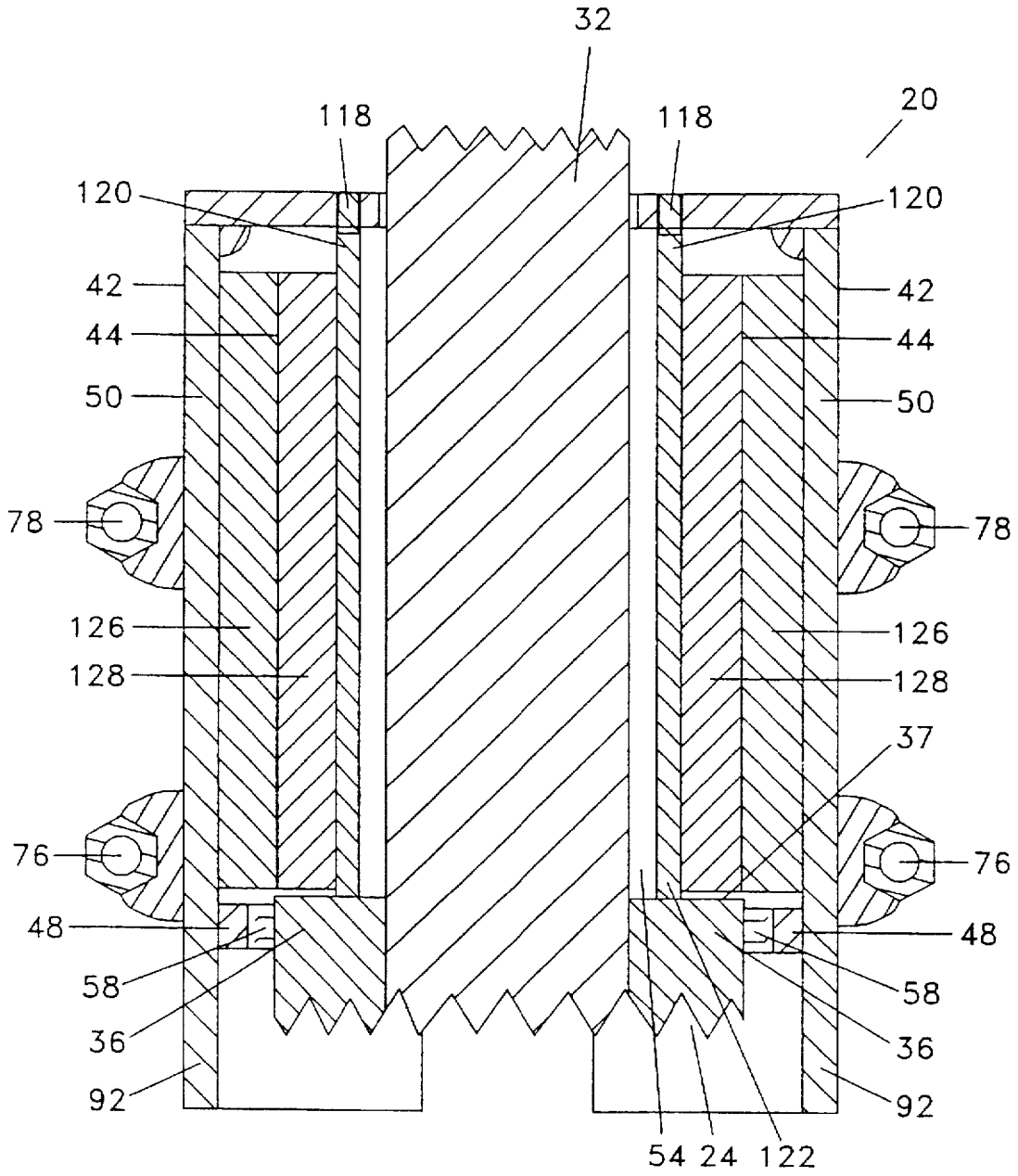
FIG. 9 is a longitudinal section of the first embodiment of the device along line 9—9 of FIG. 3.

Further, the stuffing box (24) on the rotary wellhead (22) may include a pair of ears (90) adjacent the upper end (36). In this case, to further assist in securing the housing (42) to the stuffing box (24), the side wall (50) of the housing (42) may be extended beyond the lower surface (48) of the housing (42) to form an extension (92). As shown in FIGS. 1 and 9, the extension (92) defines two slots (94) which are compatible with, and sized to receive, the ears (90) on the stuffing box (24). Thus, when the housing (42) is mounted on the stuffing box (24), the ears (90) are inserted into the slots (94) in order to facilitate the secure mounting of the housing (42) on top of the stuffing box (24). In the first preferred embodiment, the slots (94) are preferably 1½ inches wide, the width being measured in alignment with the circumference of the extension (92), and are preferably 1¼ inches long, the length being measured in alignment with the longitudinal axis of the housing (42) from the upper surface (46) to the lower surface (48).

The upper end (36) of the stuffing box (24) typically found on the reciprocating wellhead (22), as shown in FIG. 2, is not typically of sufficient length to allow the housing (42) to be mounted to the upper end (36) in the manner described for the rotary wellhead (22). However, where the upper end (36) is of sufficient length, the first preferred embodiment of the device (20) may also be used on the reciprocating wellhead (22). Otherwise, the second preferred embodiment of the device (20) should be used.

The upper end (36) of the stuffing box (24) of the reciprocating wellhead (22) typically includes at least one flange, and probably two flanges (96, 98) as shown in FIG. 2, located on opposite sides of the upper end (36). Each flange (96, 98) defines a first aperture or slot (100). These flanges (96, 98) are used in the second preferred embodiment to securely mount the housing (42). In the second preferred embodiment, the housing (42) includes two mounting tabs (102, 104), each mounting tab (102, 104) compatible with one of the flanges (96, 98). Further, each mounting tab (102, 104) preferably includes a second aperture or slot (106) compatible with the first aperture (100). The flanges (96, 98) and the mounting tabs (102, 104) are compatible in that when the housing (42) is mounted on top of the stuffing box (24), the flanges (96, 98) and their respective first apertures (100) are substantially in longitudinal alignment with the mounting tabs (102, 104) and their respective second apertures (106). The mounting tabs (102, 104) are welded to the side wall (50), preferably at a point substantially adjacent the lower surface (48) of the housing (42) so that each mounting tab (102, 104) is adjacent its compatible flange (96, 98) when the housing (42) is mounted to the stuffing box (24).

A fastener (108) is then used to fasten each mounting tab (102, 104) to its compatible flange (96, 98). Each fastener (108) may take any form such as a bolt, screw or clamp. However, each fastener (108) is preferably comprised of a threaded bolt (110), having an enlarged first end (112) and a second end (114), and a nut (116). The first end (112) of the bolt (110) is sized so that it is unable to pass through either the first or the second apertures (100, 106). The nut (116) is threaded to be compatible with the bolt (110). To fasten the mounting tab (102, 104) to the flange (96, 98), the second end (114) of the bolt (110) is passed through both the first and second apertures (100, 106) and then the nut (116) is threaded onto the second end (114) and tightened to the bolt (110).

When the second preferred embodiment of the device (20) is mounted, the lower surface (48) of the housing (42) abuts the top surface (37) of the stuffing box (24). Further, the seal assembly (58) is located between the lower surface (48) of the housing (42) adjacent the perimeter of the first opening (52) and the top surface (37) of the stuffing box (24) to seal between the top surface (37) of the stuffing box (24) and the lower surface (48) of the housing (42).

As indicated, in the preferred embodiments, the housing (42) contains the absorbent material (44). In order that the entire device (20) need not be replaced once the absorbent material (44) becomes saturated with the escaping fluid, the absorbent material (44) is preferably removable from the housing (42). Thus, when the absorbent material (44) is saturated, or at any prior time as desired, the old or dirty absorbent material (44) may be removed and replaced with new or clean absorbent material (44).

The absorbent material (44) may be comprised of any material, and may take any form, able to be inserted in the housing (42) and able to absorb and retain the escaping fluid. Thus, for example, the absorbent material (44) may be comprised of absorbent foam sprayed into the housing (42), or loose wood chips or chips of other absorbent material. However, in order that the absorbent material (44) is relatively easy to install and remove, the absorbent material (44) preferably comprises at least one layer of the absorbent material (44). In other words, the absorbent material (44) is formed into a layer which may be installed as a separate element into the housing (42). The layer may be formed in any manner and may or may not have a covering to it. For example, the layer may comprise a cloth bag containing loose wood chips or it may be formed from compressed absorbent material (44). However, in the preferred embodiments, each layer of the absorbent material (44) is comprised of at least one sorbent pad.

As shown in FIGS. 7–10, the layers of the absorbent material (44) are preferably contained in the housing (42) in a manner so that each layer is substantially parallel to the side wall (50) of the housing (42). Further, in order to enhance the ability of the absorbent material (44) to absorb and retain the escaping fluid, each layer of the absorbent material (44) extends substantially from the lower surface (48) to the upper surface (46) of the housing (42) and substantially along the entire side wall (50) of the housing (42).

In the preferred embodiments, the device (20) includes two layers (126, 128) of absorbent material (44). Thus, as shown in FIGS. 7 and 8, there is an outer layer (126) and an inner layer (128). Each layer (126, 128) is comprised of two sorbent pads (130, 132, 134, 136). Thus, four sorbent pads are preferably used at one time. Each longitudinal section (64, 66) includes two sorbent pads (130, 132, 134, 136) stacked adjacent each other and inserted vertically or longitudinally within the housing (42) so that each sorbent pad is substantially parallel to the side wall (50). Each sorbent pad extends substantially from the upper surface (46) to the lower surface (48). As well, the sorbent pads (130, 132) in the first longitudinal section (64) preferably extend substantially from the first to the second longitudinal side edges (68, 70), and the sorbent pads (134, 136) in the second longitudinal section (66) preferably extend substantially from the third to the fourth longitudinal side edges (72, 74). In the preferred embodiments, the sorbent pads (130, 132, 134, 136) which are used are typically square pads measuring 6 inches by 6 inches.

Although it is preferred that the sorbent pads (130, 132, 134, 136) be inserted longitudinally within the housing (42), it is possible for the sorbent pads to be stacked horizontally within the housing (42). In this case, an opening would likely need to be cut in each sorbent pad to allow passage of the polished rod (32) therethrough.

In the preferred embodiments, it is desirable that the layers of the absorbent material (44) not be allowed to sag or to come into substantial contact with the polished rod (32) as any such contact may interfere with the rotation or reciprocation of the polished rod (32). Therefore, the device (20) preferably further comprises means for maintaining the position of the absorbent material (44) within the housing (42) when the housing (42) is mounted on the stuffing box (24). The maintaining means may take any form capable of performing the necessary functions such as some kind of retaining wall or mesh between the polished rod (32) and the absorbent material (44) or members that pass through the absorbent material (44). However, in the preferred embodiments, the maintaining means are comprised of a plurality of elongated pins (118). Each pin (118) extends longitudinally through the housing (42) at least partially between the upper surface (46) and the lower surface (48). Specifically, each pin (118) in the first preferred embodiment has an upper end (120) which is threaded into the upper surface (46) of the housing (42), so that it may be removed for cleaning of the device (20), and extends through the housing (42) to a lower end (122). Preferably, the lower end (122) of the pin (118) in the first preferred embodiment extends substantially to the lower surface (48) of the housing (42). However, this is not necessary if the pin (118) is otherwise able to maintain the position of the absorbent material (44) in the housing (42). Each pin in the second preferred embodiment has the lower end (122) threaded into the lower surface (48) of the housing (42). Thus, the upper end (120) of the pin (118) in the second preferred embodiment extends substantially to the upper surface (46) of the housing (42).

Further, the longitudinal axis of each pin (118) is preferably substantially parallel to the longitudinal axis of the polished rod (32). As a result, the pin (118) will not interfere with the operation of the polished rod (32). As well, the pins (118) are spaced about the polished rod (32) in a manner to maintain the absorbent material (44) in position. It has been found that the placement of three pins (118) in each longitudinal section (64, 66) is sufficient to maintain the position of the absorbent material (44) when the absorbent material (44) is comprised of sorbent pads as described above. When using the pins (118) to maintain the position of the sorbent pads, the sorbent pads are inserted into the housing (42) between the side wall (50) of the housing (42) and the pins (118).

As indicated, the absorbent material (44) is preferably removable from the housing (42) and replaceable. It is therefore preferable that the device (20) be provided with means for indicating the retention of the escaping fluid by the absorbent material (44) without the need for removing the absorbent material (44) from the housing (42) and without the need to disassemble the device (20). Any means meeting these requirements may be used as long as it allows the user of the device (20) to be able to determine when the absorbent material (44) is saturated and thus, in need of replacement. This includes any mechanical or electrical indicator. In the preferred embodiments, the indicating means are comprised of means for viewing the absorbent material (44) contained within the housing (42) from outside the housing (42). Again, any viewing means may be used. However, preferably, an opening is cut in the side wall (50) of the housing (42) and a window (124) is inserted and sealed to the opening. The window (124) is preferably made of plastic, but may also be glass or another material allowing viewing of the absorbent material (44).

As shown in FIGS. 3 and 4, in order to allow viewing of substantially all of the absorbent material (44) contained within the housing (42), the window (124) preferably extends substantially from the upper surface (46) to the lower surface (48) of the housing (42). In the first preferred embodiment of the device (20) for use on a rotary wellhead (22), the window (124) has a longitudinal length of about 3⅛ inches and a width of about ⅝ inches. In the second preferred embodiment of the device (20) for use on a reciprocating wellhead (22), the window (124) has a longitudinal length of about 2¾ inches and a width of about ⅝ inches. However, these specific dimensions will vary depending upon the specific dimensions of the housing (42) and the absorbent material (44) to be viewed.

The embodiments of the invention in which an exclusive property or privilege is claimed are defined as follows:

1. A device for attachment to a production wellhead of the type having a stuffing box, the stuffing box having an upper end, and having a rod string protruding from the upper end of the stuffing box, for collecting and retaining a fluid escaping from between the stuffing box and the rod string at the upper end of the stuffing box, the device comprising:

(a) a housing for collecting the fluid escaping from the upper end of the stuffing box by surrounding the upper end of the stuffing box and a portion of the rod string adjacent thereto, the housing having an upper surface, a lower surface for abutting the stuffing box to mount the housing on top of the stuffing box, and a side wall extending between the upper surface and the lower surface, the lower surface defining a first opening for communication with the upper end of the stuffing box, the first opening sized to permit the rod string to pass therethrough and sized to permit the escaping fluid to pass from the stuffing box into the housing when the housing is mounted on top of the stuffing box, and the upper surface defining a second opening sized to permit the rod string to pass therethrough so that when the housing is mounted on top of the stuffing box, the rod string protrudes from the upper end of the stuffing box, through the first opening and through the second opening; and (b) an absorbent pad contained within the housing for retaining the escaping fluid collected in the housing wherein said absorbent pad is removable from the housing and replaceable.

2. The device as claimed in claim 1, wherein the housing comprises at least two complementary longitudinal sections which can be at least partially separated to facilitate the mounting of the housing on top of the stuffing box and which can be joined together once the housing is on top of the stuffing box to facilitate collection of the escaping fluid by the housing.

3. The device as claimed in claim 1, further comprising a seal assembly associated with the lower surface of the housing for providing a seal between the stuffing box and the housing when the housing is mounted on top of the stuffing box.

4. The device as claimed in claim 1, further comprising means for securing the housing to the stuffing box when the housing is mounted on top of the stuffing box.

5. The device as claimed in claim 2, further comprising means for securing the housing to the stuffing box when the housing is mounted on top of the stuffing box.

6. The device as claimed in claim 5, further comprising means for connecting the longitudinal sections of the housing when they are joined together in order to maintain the longitudinal sections in joined relationship with each other.

7. The device as claimed in claim 6, wherein the housing comprises a first longitudinal section having a first longitudinal edge and a second longitudinal edge, a second longitudinal section having a third longitudinal edge and a fourth longitudinal edge, and wherein the connecting means comprises:

(a) a first fastener assembly associated with the first longitudinal section and the second longitudinal section for connecting the first longitudinal edge in joined relationship with the fourth longitudinal edge when the first longitudinal section and the second longitudinal section are joined together; and (b) a second fastener assembly associated with the first longitudinal section and the second longitudinal section for connecting the second longitudinal edge in joined relationship with the third longitudinal edge when the first longitudinal section and the second longitudinal section are joined together.

8. The device as claimed in claim 7, wherein the upper end of the stuffing box has an outer circumference, wherein the first opening is sized to abut firmly the outer circumference of the upper end of the stuffing box when the housing is mounted on top of the stuffing box, and wherein the housing is secured to the stuffing box by the connecting means, which urges the first opening into firm abutment with the outer circumference of the upper end of the stuffing box.

9. The device as claimed in claim 8, wherein the first opening comprises a seal assembly located around the perimeter of the first opening, for providing a seal between the housing and the outer circumference of the upper end of the stuffing box.

10. The device as claimed in claim 9, wherein the seal assembly is compressible so that the connecting means operate to compress the seal assembly about the outer circumference of the upper end of the stuffing box in order to cause the first opening to abut firmly the outer circumference of the upper end of the stuffing box.

11. The device as claimed in claim 6, wherein the stuffing box includes at least one flange, and wherein the securing means are comprised of:

(a) at least one mounting tab located on the housing; and (b) at least one fastener for fastening the mounting tab to the flange in order to secure the housing to the stuffing box.

12. The device as claimed in claim 11, wherein the flange defines a first aperture, wherein the mounting tab defines a second aperture, and wherein the fastener comprises a bolt having an end sized for passing through the first aperture and the second aperture and a nut for threading onto the end of the bolt once the bolt is passed through the first aperture and the second aperture in order to fasten the mounting tab to the flange.

13. The device as claimed in claim 11, wherein the housing comprises a first longitudinal section having a first longitudinal edge and a second longitudinal edge, a second longitudinal section having a third longitudinal edge and a fourth longitudinal edge, and wherein the connecting means comprises:

(a) a first fastener assembly associated with the first longitudinal section and the second longitudinal section for connecting the first longitudinal edge in joined relationship with the fourth longitudinal edge when the first longitudinal section and the second longitudinal section are joined together; and (b) a second fastener assembly associated with the first longitudinal section and the second longitudinal section for connecting the second longitudinal edge in joined relationship with the third longitudinal edge when the first longitudinal section and the second longitudinal section are joined together.

14. The device as claimed in claim 13, wherein the upper end of the stuffing box has a top surface, and wherein the lower surface of the housing abuts the top surface of the upper end of the stuffing box when the housing is mounted on top of the stuffing box.

15. The device as claimed in claim 14, wherein the lower surface of the housing comprises a seal assembly for providing a seal between the housing and the top surface of the upper end of the stuffing box.

16. The device as claimed in claim 6, wherein the absorbent pad is contained within the housing so that it is substantially parallel to the side wall of the housing, extends substantially from the lower surface to the upper surface of the housing, and extends substantially around the entire side wall of the housing.

17. The device as claimed in claim 6, further comprising means for maintaining this position of the absorbent pad within the housing when the housing is mounted on the stuffing box.

18. The device as claimed in claim 17, wherein the maintaining means are comprised of a plurality of elongated pins extending longitudinally through the housing for at least a portion of the distance between the upper surface and the lower surface and wherein the absorbent pad is contained within the housing between the side wall and the pins.

19. The device as claimed in claim 6, further comprising means for indicating the retention of the escaping fluid by the absorbent pad without removing the absorbent material from the housing.

20. The device as claimed in claim 19, wherein the indicating means are comprised of means for viewing the absorbent pad contained within the housing from outside of the housing.

21. The device as claimed in claim 20, wherein the viewing means are comprised of a window mounted in the side wall of the housing.

* * * * *